US006443789B2

(12) United States Patent
Tominetti et al.

(10) Patent No.: US 6,443,789 B2
(45) Date of Patent: Sep. 3, 2002

(54) DEVICE AND METHOD FOR INTRODUCING HYDROGEN INTO FLAT DISPLAYS

(75) Inventors: Stefano Tominetti, Milan; Alessio Corazza, Como, both of (IT)

(73) Assignee: Saes Getters S.p.A., Lainatr (IT)

( * ) Notice: Subject to any disclaimer, the term of this patent is extended or adjusted under 35 U.S.C. 154(b) by 0 days.

(21) Appl. No.: 09/727,206

(22) Filed: Nov. 30, 2000

Related U.S. Application Data

(63) Continuation of application No. PCT/IT00/00159, filed on Apr. 19, 2000.

(30) Foreign Application Priority Data

Apr. 21, 1999 (IT) ..... MI99A0836

(51) Int. Cl.[7] ..... H01J 7/20
(52) U.S. Cl. ..... 445/53; 445/73
(58) Field of Search ..... 445/53, 57, 73

(56) References Cited

U.S. PATENT DOCUMENTS

| | | | | |
|---|---|---|---|---|
| 3,822,086 A | | 7/1974 | Paik | |
| 5,883,467 A | | 3/1999 | Chalamala et al. | |
| 5,982,095 A | * | 11/1999 | Jin et al. | 313/582 |
| 6,077,141 A | | 6/2000 | Meyer et al. | |
| 6,169,364 B1 | * | 1/2001 | Van Slooten et al. | 313/582 |

FOREIGN PATENT DOCUMENTS

| | | |
|---|---|---|
| EP | 0 816 898 A2 | 1/1998 |
| EP | 0 833 363 A2 | 4/1998 |
| EP | 0 838 832 A1 | 4/1998 |
| EP | 0 716 772 B1 | 1/1999 |
| JP | 10-199454 A | 7/1998 |
| WO | WO 98/57219 A1 | 12/1998 |

OTHER PUBLICATIONS

C. A. Spindt, et al., "Field–Emitter Arrays for Vaccuum Microelectronics", *IEEE Trans. Electron Devices*, 38(10): 2355–2363, (Oct. 1991).

M. S. Mousa. "A Study of the Effect of Hydrogen Plasma on Microfabricated Field–Emitter Arrays", *Vacuum*, 45(2/3): 235–239, (1994).

* cited by examiner

*Primary Examiner*—Kenneth J. Ramsey
(74) *Attorney, Agent, or Firm*—Akin, Gump, Strauss, Hauer & Feld, L.L.P.

(57) ABSTRACT

A device (10) for introducing hydrogen into a flat display (14) of the field emission or plasma addressed liquid crystal type is described, formed of a reservoir (11) containing a hydrogen accumulator material (21) connected to the internal space (13) of the display by means of a wall (15) permeable to the passage of hydrogen gas as a function of the temperature. The device comprises a heater (19) and a heater (22) for bringing respectively the wall and the accumulator material to the desired temperatures, or a single heater which carries out both cited functions. There is also described a method by which the device is activated whenever the flat display is working, the switching on of said heater being arranged in order to bring the wall itself to a previously calculated temperature.

10 Claims, 3 Drawing Sheets

DEVICE AND METHOD FOR INTRODUCING HYDROGEN INTO FLAT DISPLAYS

CROSS-REFERENCE TO RELATED APPLICATION

This application is a continuation of International Application No. PCT/IT00/00159 filed Apr. 19, 2000 the disclosure of which is incorporated herein by reference.

The present invention relates to a device and a method for introducing hydrogen into flat displays.

Particularly, the invention relates to a device and method for introducing hydrogen into field emission displays (generally known in the art as "Field Emission Displays" or FED) and liquid crystal displays wherein the orientation of the liquid crystals is controlled by means of a plasma (generally known in the art as "Plasma Addressed Liquid Crystal" displays or PALC), in order to maintain the hydrogen partial pressure in these devices within a desired range of values. The main use of these types of displays is replacing the traditional television screens based on the cathodic tube, which is heavier and more encumbering. Other uses, especially in the case of PALCs, are the boards for providing traffic information, in railway stations or airports.

In principle, the internal space of a FED should be kept under vacuum, and that of a PALC plasma chamber should contain only the rare gas necessary for the plasma formation, generally helium at pressures of about 50–500 mbar. However, both devices are known to work better and particularly to maintain their functional capacity for a longer time, if small quantities of hydrogen are present inside them.

As described in the articles of Spindt et al., in IEEE Transactions on Electron Devices, vol.38, n. 10 (1991), p.2355–2363, and of Mousa, in Vacuum, Vol. 45, n. 2–3 (1994) p. 235–239, in a FED hydrogen has the function of avoiding the oxidation of the metal electron-emitting microtips; the optimal hydrogen pressure is about between $10^{-5}$ and $2\times10^{-1}$ mbar.

In PALCs, hydrogen has the function of accelerating the decay time of the helium plasma, by accelerating the return of the single spots which form the display (in the art defined "pixel") from the "switched on" to the "switched off" condition; a high speed of this transition is necessary for the transmission of high definition television images. Patent application EP-A-816898 can be referred to for a detailed description of the mechanisms and problems of the PALC functioning; hydrogen partial pressures of about 0,1–100 mbar, and preferably between 1 and 10 mbar, are optimal for the functioning of the PALC.

The introduction of the desired hydrogen quantities in these displays can be carried out during the manufacturing, for example by filling up with hydrogen gas after evacuation of the internal space of the FED or of the plasma chamber in the case of PALCs; the filling up operation can be carried out by means of the same (generally glass) tubulation used for the evacuation, which can later be sealed by heat compression (technique known as "tip-off").

However, hydrogen is consumed during the life of these displays. In particular, the hydrogen consumption rate has been observed to be noteworthy when the display is on, while it is negligible when it is off. The reason for this behavior is believed to be the hydrogen ionization, with formation of the $H^+$ion when displays are switched on, which in the FEDs is due to the interaction with the electronic beams and in the PALCs to the plasma formation; the thus formed $H^+$ions are accelerated by electric fields, also present with switched on displays, against internal portions thereof, mainly the metallic microtips in the FEDs or the electrodes in the PALCs, and sorbed by these portions.

Therefore, it is necessary to provide for a possibility of supplying the gas, when it is necessary, in the internal space of these displays during their life. The systems which have been devised up to now for this purpose are based on the employment of hydrogen accumulator materials, generally zirconium or titanium based alloys which can sorb and emit hydrogen according to equilibrium conditions that are characteristic for each alloy. These alloys can be "charged" with hydrogen quantities up to a few percent of their weight, by heating them to temperatures between about 50 and 200° C. with contemporaneous exposure to hydrogen at pressures between about $10^{-4}$ and 2 bars. The charged hydrogen can be subsequently released from the alloy when this is exposed to hydrogen partial pressures lower than the equilibrium partial pressure for the specific alloy at the specific temperature. This kind of alloys charged with hydrogen can be positioned inside the display in communication with the internal space thereof and possibly they can be heated up to temperatures between about 40 and 500° C. when the hydrogen pressure decreases under the values above indicated for FEDs and PALCs, in order to re-establish the optimal working atmosphere in the device. The employment of zirconium or titanium alloys, based on their hydrogen sorption and emission equilibrium properties, is described for example in patent applications EP-A-716772, EP-A-838832 and JP-A-10/199454, relating to FED type displays, and in patent applications EP-A-816898, EP-A-833363 and WO 98/57219, relating to PALC type displays.

The prior art systems, although in principle effective for maintaining hydrogen at the desired levels, are difficult to be put into practice, because it is difficult to define a specific alloy with hydrogen equilibrium pressures as a function of the temperature which can generate the desired hydrogen pressures inside the displays. Specifically, the main difficulty which is found with these systems is that these alloys generally have very low hydrogen equilibrium pressures around the room temperature (the working temperatures of FEDs and PALCs), so that most of the hydrogen released by heating the alloy is subsequently sorbed again by the alloy itself when cold; at temperatures around the room temperature, the alloy works as a hydrogen getter, rather than as a source thereof, since it can sorb also the hydrogen which has been intentionally supplied into the display during the manufacturing steps.

With patent application M199A 000534 the applicant intended to provide a device and method for the introduction of hydrogen into flat devices, free from the drawbacks of the above listed methods, based on the use of a portion of passage wall between a hydrogen supply and the flat display formed of a proton conductor material. The passage of hydrogen gas through said wall is controlled by means of two electrodes, the first of which is connected to the proton conductor material surface facing the reservoir inside and the second to the surface facing the display internal space, means for heating the portion made with proton conductor material being provided. The method further necessarily comprises a continuous monitoring of the hydrogen partial pressure in the display or at least the detection thereof when it drops under a predetermined critic value, to enable the application of a suitable potential difference between the two electrodes.

SUMMARY OF THE INVENTION

Object of the present invention is to provide a device and method for introducing hydrogen into flat displays which do not need pressure detectors capable of controlling a potential difference being applied, in the desired sense, on electrodes connected to the two faces of a proton conductor material, but which provide instead a self-regulated system without any external intervention.

This object is achieved according to the present invention by means of the device features set forth in claim 1 and by means if the method features set forth in claim 7.

These and other objects, advantages and features of the device and relating method will appear more clearly from the following detailed description given for some different embodiments with reference to the accompanying drawings, wherein.

Figure 3:
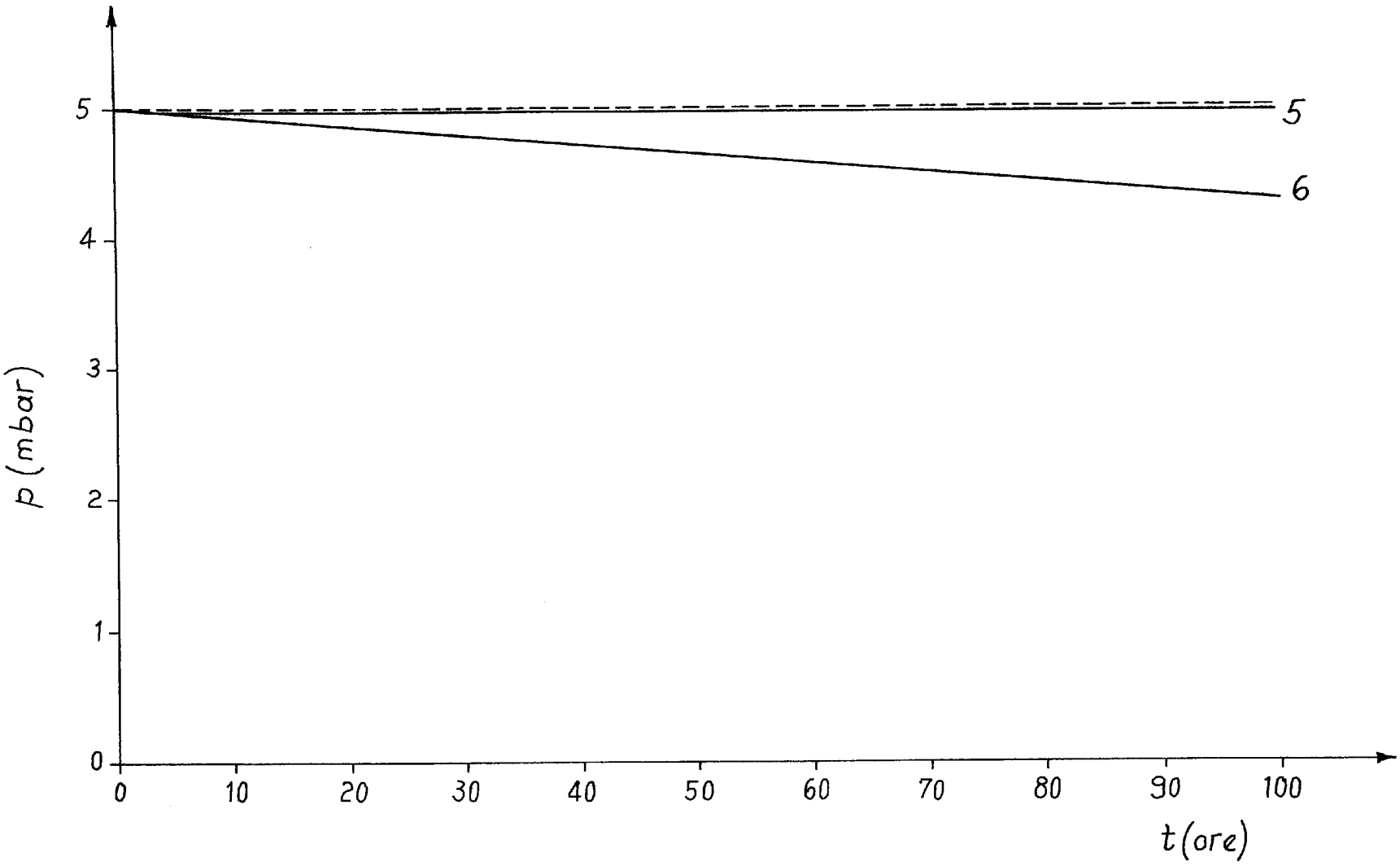

FIG. 3 graphically shows the variation trend of hydrogen partial pressure in a flat display provided with the device of the invention and in one not provided with said device.

DETAILED DESCRIPTION OF THE INVENTION

The device according to the invention is formed of a reservoir containing a material which is able to accumulate and release hydrogen as a function of the temperature; the reservoir walls are made of a hydrogen-tight material, but for a portion, generally a membrane made of a material which is hydrogen permeable as a function of the temperature, preferably palladium or alloys thereof or iron or alloys thereof; the membrane connects the reservoir with the display internal space. The flow F of hydrogen gas which can permeate through said membrane is given from the well known equation:

$$F=A/d\cdot k_0\cdot e^{-Ek/KT}\cdot(\sqrt{p_2}-\sqrt{p_1}) \quad \text{(I)}$$

wherein A is the membrane area, d the thickness thereof, $k_0$ and $E_k$ respectively are the pre-exponential factor and the activation energy for the permeation, which depend both on the material forming the membrane, and $p_1$ and $p_2$ are the hydrogen pressure values on the membrane opposing faces. By defining with $p_2$ the pressure value on the side of the reservoir and with $p_1$ that on the side of the display, the flow will be directed from the reservoir to the display when $p_2>p_1$, and in the opposite direction when $p_2>p_1$; when $p_2=p_1$, the equilibrium is achieved and the net flow through the membrane is null. Independently on the flow direction, the velocity thereof increases with the membrane temperature.

Figure 1:
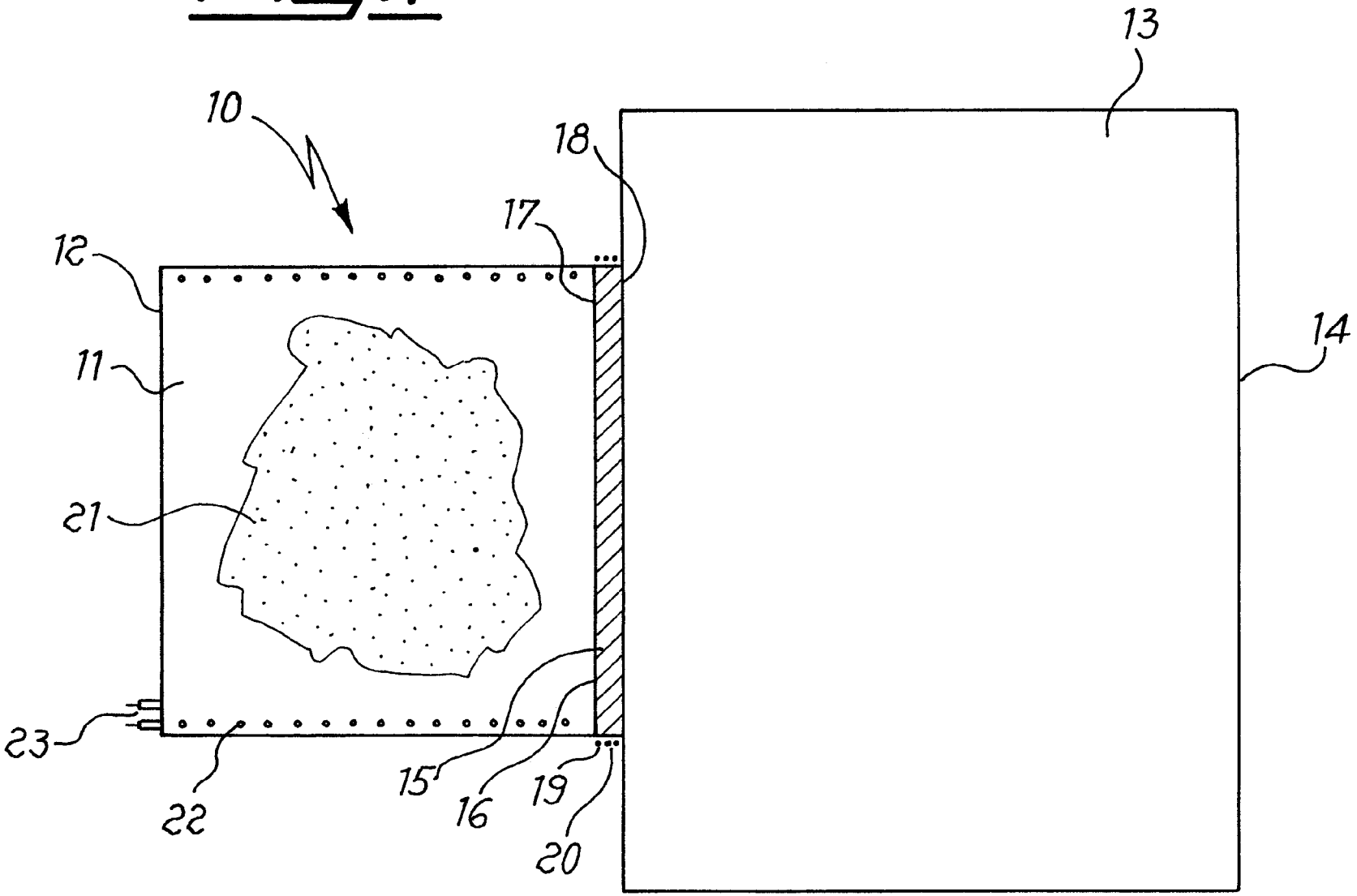
FIG. 1 shows schematically a possible embodiment of the device according to the present invention.

With reference to the drawings, in FIG. 1 the device of the invention is shown in a schematic way and according to a generic embodiment. Device 10 is formed of a reservoir 11 delimited by an assembly of walls, generally indicated as member 12. The device is connected to the internal space 13 of a flat display 14 of the FED or PALC type by means of a wall (or a portion thereof) formed of a membrane 15 made of a material 16 which is permeable to the passage of hydrogen gas as a function of the temperature, which is provided with a surface 17 facing reservoir 11 and a surface 18 facing space 13. Around said membrane 15, or anyway next to it. a heater 19 of any type is provided, suitable for checking the temperature of said membrane 15 and formed for example of an electric resistor fed from the outside, of which only a few turns can be seen schematically in section. A material 21, able to accumulate hydrogen and release it by heating, is provided in the reservoir 11; material 21, also called "buffer", can be one of the titanium- or zirconium-based alloys described in the previously cited prior art documents, and particularly ZrCo, ZrNi, $ZrCo_{1-x}Ni_x$, or a ternary Zr—V—Fe alloy, but also a lanthanum-based alloy such as $LaNi_5$ o $LaNi_{5-x}Al_x$. The material is chosen so that, at a temperature $T_1$ which is easily achievable in the device, the equilibrium hydrogen pressure thereof is equal to the hydrogen pressure value, $p_s$, which is desired to be kept in the space 13 of the display, and at which said space can be charged already during the manufacturing step. Temperature $T_1$ is generally comprised between room temperature and about 400° C.; lower temperatures would require cooling systems of the device which are generally not easy to construct and use, while temperatures higher than those indicated would require higher power for the achievement thereof and might cause damages to the device itself. Generally, material 21 is chosen so that the temperature $T_1$ at which the equilibrium pressure thereof equals $p_s$ is between about 150 and 300° C. A heating member can be provided for heating material 21, such as a resistor 22 directly positioned inside reservoir 11, and supplied by means of a connector 23 as shown, or outside thereof.

As previously said, hydrogen having pressure $p_s$ (total in the case of FEDs and partial in the case of PALCs) is introduced inside space 13 during the manufacturing step of the display 14. During the display life, hydrogen is consumed and its pressure is reduced to a value $p_x<P_s$. In order to re-establish the desired pressure in the display, material 21 is brought to temperature $T_1$ by means of heater 22, the reservoir pressure reaches value $p_s$ and, according to equation (I), a flow from the reservoir to space 13 is established. which stops when the pressure inside the latter reaches again the desired value $p_s$. The achievement of said condition could be detected by suitable sensors positioned in space 13 but, in order to simplify the display construction, it is preferable to maintain device 10 constantly heated when the display is on, so that the pressure is continuously self-regulated to the value $p_s$. In order to favor hydrogen transport, it is possible to operate on the membrane temperature, by keeping the same at a value $T_2$ which is as high as possible; however, this value cannot raise above about 400° C., in order to avoid damaging other components of the display. For the same purpose it is also preferable to have membranes with the lowest possible thickness.

When the display is off, also device 10 is preferably not fed, especially in order to save energy. In these conditions, all the components of the display and of device 10, among which material 21, are brought to room temperature, $T_a$, which in the case that the displays are employed for traffic signs or in other environments, can vary within about 0 and 50° C. At these temperatures, materials 21 generally have very low equilibrium pressures, so that, according to equation (I), the flow would be directed towards the reservoir and device 10 would be inclined to sorb practically all the present hydrogen. Therefore, it is necessary that membrane 15 has the lowest possible permeability values at $T_a$. In this case, being the temperature fixed, the flow control can be carried out only by means of the membrane thickness, which must be as high as possible.

Figure 2:
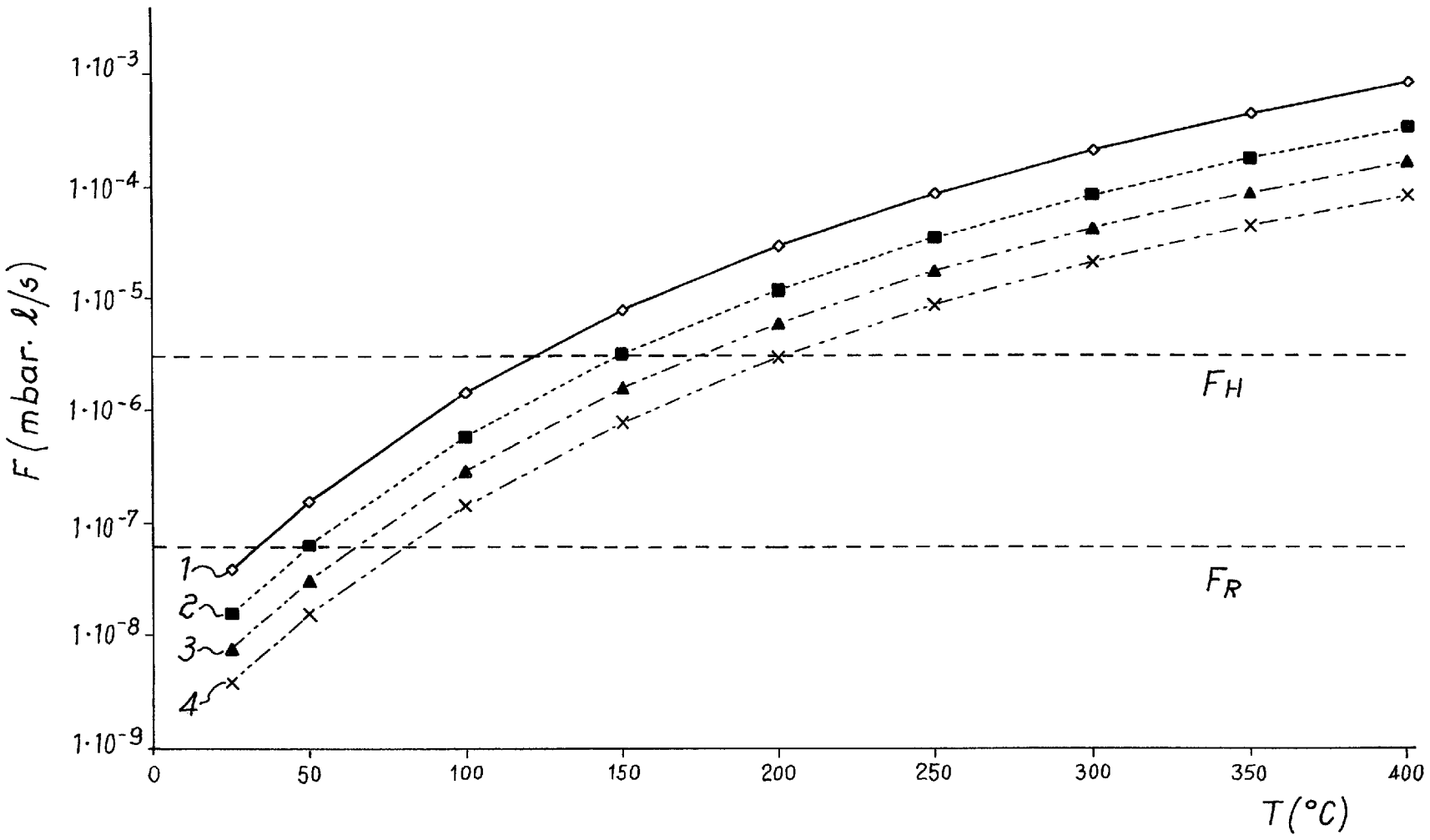
FIG. 2 shows a graph wherein the hydrogen gas flow through a permeable palladium wall of the device according to the invention is plotted against the wall temperature, for four different thickness values.

The thickness d of the membrane 15 shall therefore be determined by considering the opposite needs of having a good permeability when the temperature thereof is $T_2$ and a reduced permeability when the temperature thereof is $T_a$. In order to determine thickness d, it is convenient to refer to the curves shown in the graphic of FIG. 2, which represent the flow, F (expressed in mbar·l/s) passing through the membranes of palladium of different thicknesses as a function of the membrane temperature T expressed in °C.; the curves in FIG. 2 numbered from 1 to 4, refer to membranes of respective thicknesses 0,1 mm, 0,25 mm, 0,5 mm and 1 mm and are valid for membranes having area 0,25 $cm^2$ and when the hydrogen pressure difference, $\Delta p=p_2-p_1$ between the two membrane faces is 5 mbars. The value of the membrane area is representative of a typical application in displays, wherein the surfaces in the internal space 13 are mainly occupied by the active components thereof and the area available for the membrane is reduced. The value of 5 mbar for the Δp has been chosen instead as representative of the worst conditions which can occur in the PALC type displays, by assuming that 5 mbar is the hydrogen partial pressure value which is to be maintained inside thereof. During the functioning of the display operation, in the worst conditions space 13 will be completely evacuated from hydrogen, so that the previously defined values $p_s$ and $p_x$ will respectively equal 5 and 0 mbars, with Δp=5 mbar; when the display is off and $T=T_a$, the hydrogen pressure inside reservoir 11 can be approximated to be 0 mbar, while the partial pressure in space 13 is not higher than 5 mbar, so that a pressure difference of 5 mbar on the two membrane faces is again obtained (though of opposite sign with respect to the previous). Assuming that in the worst case $T_a$=50° C., and $T_2$ is known (defined by the displays manufacturer as the highest temperature to which membrane 15 can be brought), the curves of FIG. 2 enable us to choose a membrane thickness compatible with all the conditions wherein device 10 and display 14 can be found. Curves similar to those shown in FIG. 2 can be obtained for Δp values lower than 5 mbar, for example of about $10^{-1}$ mbar, in the case that the desired application is in the FEDs, and for membranes of other materials than palladium.

Although it is possible to foresee that temperatures $T_1$ and $T_2$, of material 21 and membrane 15 respectively during the operation of device 10 are different, the construction and operations of the device are considerably simplified when the condition $T_1=T_2$ is chosen; this condition can be achieved by just adopting a single heater instead of the two 19 and 22. This situation, preferred by the manufacturers, imposes a further bond for the choice of the thickness d of the membrane 15, because in this case the temperature thereof cannot be chosen as high as desired within the above indicated limits, in order to avoid having a too high hydrogen equilibrium pressure in reservoir 11, and particularly one higher than $p_s$, which could overload space 13 with gas.

The employment of the devices of the invention is advantageous also under the aspect of the necessary compatibility with the manufacturing process of the flat display. In fact, the accumulator material (buffer) should already be charged with hydrogen at the requested concentration before mounting the device. The thermal cycles which the assembly undergoes during the manufacturing process can bring to temperatures higher than those of the working device, causing hydrogen release from the accumulator material and gas loss due to the gas pumping during the production phases. By the prior art systems, wherein the accumulator material contacts directly the display internal space, in order to minimize the $H_2$ losses, it is necessary to position the accumulator material after the frit-sealing operation which occurs at 450° C., or maintaining it cooled during this phase, but both solutions imply some difficulties. A device of the invention based for example on ZrCo can on the other side easily bear a heating to 300° C. for 150 minutes under pumping, with hydrogen loss limited to about 3 mbar·l, which is a value absolutely tolerable with respect to the total quantity of hydrogen contained in the material, of the order of about 80 (mbar·l)/g.

A practical example of membrane thickness dimensioning and operation of the invention device is given in the following.

EXAMPLE 1

In this example reference is made to the numbering of FIG. 1. A display of the PALC type having internal volume of 150 cc is connected to a hydrogen release device of the invention, formed mainly of a reservoir with steel walls containing 1 g of the ZrCo compound precharged, according to modalities known in the art, with 8 mg of hydrogen. The internal volume of the PALC and the reservoir are connected to each other by means of a palladium membrane having a surface of 0,25 $cm^2$. For heating the membrane and, through the reservoir walls, the compound ZrCo, a single resistance is employed, so that in operative conditions the compound and the membrane are at the same temperature. The PALC is charged, by means of a glass tubulation, with a mixture of helium/hydrogen having total pressure of 150 mbars wherein hydrogen is present at a partial pressure of 5 mbar, indicated in FIG. 3 by a dotted line. The tubulation employed for the filling operation with the gas mixture is then connected to a gas sampling system which is in turn connected, by means of an expansion chamber, to a mass spectrometer for measuring the chemical composition of the gas contained in the PALC. The thickness of the membrane is determined by referring to the curves of FIG. 2, with the conditions, made known by the PALC manufacturer, that the hydrogen consumption when the display is on is of about $3\cdot10^{-7}$ (mbar·l)/s, and that the maximum hydrogen loss acceptable when the display is off at 50° C. is for example 1 mbar in a hundred days, which is equivalent, in the device described, to a permeation flow of about $6\cdot10^{-8}$ (mbar·l)/s; this value of removal flow, $F_r$, is represented in the figure by a first dotted line. When the display is on, the hydrogen flow towards space 13 is required to be at least equal to the above indicated hydrogen consumption rate, and preferably of one order of magnitude higher; the preferred flow value $F_H$, which in this case is $3\cdot10^{-6}$ (mbar·l)/s, is indicated in the drawing by a second dotted line. The material ZrCo is in equilibrium with a hydrogen pressure of 5 mbar at about 180° C. and, according to the preferred embodiment of the invention, said temperature is imposed also to membrane 15. The conditions that the membrane has a permeation flow lower than $6\cdot10^{-8}$ (mbar·l)/s at 50° C. and higher than $3\cdot10^{-6}$ (mbar·l)/s at 180° C. define a membrane thickness of 0,35 mm. Membrane 15 and material ZrCo are heated up to 180° C. and the display is switched on and left for some hours in operation: the partial pressure of hydrogen contained in the screen is measured every hour, by extracting by the tubulation gas samples having the volume of 0,5 cc and analyzing them by means of a mass spectrometer. The variation trend of the so measured hydrogen partial pressure (expressed in mbars) during time (in hours) is given in FIG. 3 as curve 5.

EXAMPLE 2 (COMPARATIVE)

The test of example 1 is repeated with a PALC having no hydrogen releasing device according to the invention connected thereto. The trend of the hydrogen partial pressure in time is given in FIG. 3 as curve 6.

As it can be seen from comparison between curves 5 and 6 in FIG. 3, the device and method according to the invention allow hydrogen partial pressure to be maintained essentially constant in a PALC. but for slight fluctuations, while in a PALC without said device the hydrogen partial pressure decreases by 14% of the initial value in the first 100 life hours.

Therefore, by the devices and the method of the invention it is enough to feed the heaters (or the single heater) of the buffer material and of the membrane in order to obtain a complete self-regulation of the hydrogen partial pressure in flat displays, no external control being required.

We claim:

1. Device (10) for introducing hydrogen into flat displays (14) formed of:

a reservoir (11) containing a material (21) able to release hydrogen, whose walls (12) are made of a hydrogen-tight material but for a portion (15) made of a material (16) which is permeable to $H_2$ gas as a function of the temperature and has one surface (17) facing said reservoir (11) and one opposite surface (18) facing the internal space (13) of said flat display; and means (19) for heating said portion (15) wherein heating of the portion is activated contemporaneously with operation of the flat display.

2. Device according to claim 1, wherein the walls (12) of the reservoir (11) are made of metal, ceramic or glass.

3. Device according to claim 1, wherein said material (16) which is permeable to hydrogen as a function of the temperature is chosen among palladium and alloys thereof or iron and alloys thereof.

4. Device according to claim 1, wherein said hydrogen releasing material (21) is chosen among zirconium-, titanium- or lanthanum-based alloys.

5. Device according to claim 4, wherein said hydrogen releasing material (21) is chosen among ZrCo, ZrNi, $ZrCo_{1-x}Ni_x$ or the Zr—V—Fe ternary alloys.

6. Device according to claim 4, wherein said hydrogen releasing material (21) is chosen among $LaNi_5$ and alloys $LaNi_{5-x}Al_x$.

7. Method for introducing hydrogen into flat displays by means of a device according to claim 1 comprising the step of heating at least the portion positioned between said reservoir and the internal space of the flat display and which is hydrogen permeable as a function of the temperature.

8. Method according to claim 7, wherein also the hydrogen releasing material is heated.

9. Method according to claim 7, wherein said permeable wall portion and said hydrogen releasing material are both heated to the same temperature T.

10. Method according to claim 7, wherein the portion made of hydrogen permeable material is heated at a temperature higher than the heating temperature of the hydrogen releasing material.

* * * * *